US005320519A

United States Patent [19]

Bang et al.

[11] Patent Number: 5,320,519

[45] Date of Patent: Jun. 14, 1994

[54] METHOD FOR CONTROLLING CARBURETOR HEATER AND APPARATUS THEREFOR

[75] Inventors: Yong-Ung Bang; Su-Young Cha, both of Kyonggi-do, Rep. of Korea

[73] Assignee: Samsung Electronics Co., Ltd., Suwon, Rep. of Korea

[21] Appl. No.: 13,103

[22] Filed: Feb. 3, 1993

[30] Foreign Application Priority Data

Feb. 27, 1992 [KR] Rep. of Korea ..... 92-3083

[51] Int. Cl.[5] ..... F23D 11/44

[52] U.S. Cl. ..... 431/11; 431/208; 123/543; 123/549; 123/552

[58] Field of Search ..... 431/11, 208; 123/543, 123/545, 549, 550, 552, 557, 546

[56] References Cited

U.S. PATENT DOCUMENTS 4,634,367 1/1987 Kasada ..... 431/208 X
5,044,331 9/1991 Suga et al. ..... 123/543

FOREIGN PATENT DOCUMENTS 49918 3/1986 Japan ..... 431/11
62-41521 2/1987 Japan .
82007 3/1990 Japan ..... 431/208

*Primary Examiner*—Larry Jones
*Attorney, Agent, or Firm*—Burns, Doane, Swecker & Mathis

[57] ABSTRACT

A method for controlling a heater of a carburetor and an apparatus therefor. The method includes the steps of: setting a heater pre-heating temperature condition so as for the fuel to be vaporized at the optimum state; setting a heater temperature variation rate properly in accordance with the variation of the intra-room temperature; setting a heater temperature variation rate in relation with the latent heat of the material of the heater; controlling the phase angle of an ac power in accordance with the instructions of a microcomputer; and driving the heater with the variable ac power. Thus a proper vaporizing atmosphere is formed in relation with the variations of the surrounding conditions, thereby contributing to the full combustion of the fuel. The apparatus for controlling the heater is constituted such that a heater temperature sensing section and an intra-room temperature sensing section are connected to the input side of the microcomputer, while the output side of the microcomputer is connected to a phase angle control section.

8 Claims, 4 Drawing Sheets

METHOD FOR CONTROLLING CARBURETOR HEATER AND APPARATUS THEREFOR

FIELD OF THE INVENTION

The present invention relates to a carburetor of a vaporizing type fuel combustion apparatus using vaporized kerosene as the fuel, and particularly to a method for controlling a carburetor heater and an apparatus therefor, in which an AC power source supplied to the heater is controlled based on a phase angle control method in relation with the external conditions such as variations of the intra-room temperature and variations of the latent heat of the heater coming from the material characteristics of the heater, thereby making it possible to maintain the intra-heater temperature at a constant level.

BACKGROUND OF THE INVENTION

Japanese Laid-Open Patent Application No. Sho-62-41521 discloses an apparatus for controlling a carburetor heater as shown in FIG. 1.

Referring to FIG. 1, an electro-magnetic pump 21 supplies kerosene from a fuel tank 22 through a fuel pipe 23 to a vaporizing chamber 25 of a carburetor 24. A heater 26 heats the carburetor 24, and a control means 27 controls the electric current flowing through the heater in accordance with the temperature level detected by a temperature sensor 28.

Further, a needle 29 opens and closes a nozzle hole 30, and a burner 31 is installed opposingly facing the nozzle hole 30, while there are installed an igniting plug 32 and a flame detector 35 on the top of the burner 31, the igniting plug 32 being for igniting the vaporized fuel, and the flame detector 35 being for detecting the ion current of the flames.

A judging means 33 which is connected to the temperature sensor 28 judges whether the pre-heated temperature as detected by the sensor 28 is higher than a pre-set igniting temperature. If the pre-set temperature of a power level setting means 34 is lower than the pre-heated temperature, the electric power setting means 34 lowers the power level supplied to the heater 26.

The above described conventional heater control apparatus can also be applied to a carburetor having the following burner structure.

As; shown in FIG. 2, the burner has a vaporizing chamber 41 for vaporizing the fuel, and has a mixing chamber 42 for mixing the vaporized fuel with air. These two chambers are separated by a mixing plate 44 having a communicating hole 43.

Further, an air supply tube 47 which is connected to a blowing fan 46 is installed at a lower side portion of a vaporizing wall 45 of the vaporizing chamber 41, while a fuel supply nozzle 48 is installed within the air supply tube 47.

Further, a flame hole 49 for forming flames is formed at an upper portion of the vaporizing chamber 41, while a heater 50 is embedded in the vaporizing wall 45 which separates the vaporizing chamber 41. Temperature sensors (not shown) are installed around the heater 50 to maintain the insulated state of the heater 50 and to detect the heat release of the heater 50, and these temperature sensors are embedded in the vaporizing wall 45 together with the heater 50.

The conventional carburetors described as above are controlled in the following manner.

In order to vaporize the fuel, the atmosphere within the vaporizing chamber has to be suitable for vaporizing, and this is achieved by pre-heating the heater.

That is, if an activating switch (not shown in FIG. 1) is turned on, the heater 26 is completely energized, thereby heating up the carburetor 24.

The temperature of the carburetor 24 is detected by the temperature sensor 28, while the control means 27 judges whether the data detected by the temperature sensor 28 indicates an ignitable temperature of the pre-determined level.

If it is found that the detected temperature has not reached an ignitable temperature, the control means 27 further completely energizes the heater 26, thereby heating the heater 26 further.

If the temperature detected by the temperature sensor 28 has reached an ignitable level, an ignition is carried out, and the electro-magnetic pump 21 is activated to supply the kerosene from the fuel tank 22 through the pipe 23 to the carburetor 24. The supplied fuel is heated and vaporized to be spurted through the nozzle hole 30.

Then the vaporized fuel sucks in ambiet primary air in order to use it for combustion, and this mixed gas is introduced into the burner 31. After the pre-heating, the igniting plug 32 which is installed on the burner 31 produces sparks to ignite the mixed gas.

After the ignition, the flame detector 35 detects the ion current of the flames, and, if the magnitude of the ion current reaches a pre-determined level, the control means 27 stops the spark discharge operation of the igniting plug 32.

Meanwhile, the temperature data detected by the temperature sensor 28 is inputted into a microcomputer (not shown) which is installed within the judging means 33. The microcomputer compares pre-stored temperature data (set at slightly lower than the igniting temperature) with the inputted data, and judges whether the temperature data from the temperature sensor 28 is higher than the pre-stored temperature data.

If the detected temperature is lower than the pre-set temperature, the judging means 33 supplies a control signal to the output level setting means 34, so that the output level setting means 34 should control the input power to fully energize the heater 26.

Thereafter, if it is found that the detected temperature is higher than the pre-set temperature, the power level setting means 34 curtails the amount of the input power for the heater 26 for example by 50 so that the temperature within the carburetor 24 should be maintained at a constant level. Then after the carrying out the igniting operation, the AC power supplied to the heater 26 is withheld.

That is, as shown in FIG. 1 in the conventional carburetor 24 26, when driving the heater, the temperature sensor 28 which is installed adjacent to the heater 26 simply detects the temperature of the heater 26, and, when the judging means 33 finds that the detected temperature has reached the pre-set temperature, the judging means 33 controls the AC power source to stop driving the heater 26.

Thereafter, when the temperature of the heater 26 reaches a lower limit of the pre-stored temperature data, the microcomputer turns the heater power section on again to resume the pre-heating operation of the carburetor 24.

Thus conventionally, the temperature of the heater 26 is varied between lower and upper limits, and therefore, the atmosphere within the burner 31 cannot be maintained in a perfect manner.

Further, even when the input electric power is withheld from the heater 26 during the heat release of the heater 26, the heater 26 raises the temperature above the temperature at the power disconnection, because of the latent heat in the material of the heater 26. On the other hand, when the heater 26 is disconnected from the power source for a certain period of time, even if the ac power supply is resumed, the heater 26 is cooled down to below the lower limit. Consequently, the atmosphere within the vaporizing chamber 25 becomes unstable, and therefore, the combustion becomes imperfect. In such a case, white smoke with the odor of kerosene is produced within the burner 31, thereby polluting the interior atmosphere of a room.

SUMMARY OF THE INVENTION

The present invention is intended to overcome the above described disadvantages of the conventional techniques.

Therefore it is an object of the present invention to provide a method for controlling a heater of a carburetor in which the AC power supplied to the heater is controlled by applying a phase angle control method in accordance with the external conditions such as the intra-room temperature and the latent heat of the material of the heater, so that the temperature of the vaporizing chamber can be maintained at a constant level, thereby making combustion stable.

It is another object of the present invention to provide an apparatus for controlling a heater of a carburetor, in which there are separately provided a heater temperature sensing section for sensing the intra-room temperature and a phase angle control section for controlling the phase angle of the AC power, in such a manner that the phase angle of the AC power supplied to the heater can be varied in accordance with the external conditions, thereby making it possible to maintain the temperature within the carburetor at a constant level.

In achieving the above objects, the control method of the present invention includes the steps of: setting the optimum pre-heating temperature condition for vaporizing the fuel by taking into account the heating capacity of a heating apparatus; setting the temperature variation range in relation with the intra-room temperature; setting the temperature variation range in relation with the latent heat coming from the material characteristics; storing the above mentioned data into a microcomputer by entering them; comparing by the micro-computer this pre-set data with an inputted data the inputted data furnished by a temperature sensor; controlling the phase angle of the AC power based on the discrimination of the microcomputer; and driving the heater by means of the variable power.

In achieving the above objects, the apparatus of the present invention includes: a heater temperature sensing section for sensing the temperature of a heater by means of a temperature sensor such as thermistor; a microcomputer for computing the power phase and its control amount by comparing a pre-set temperature parameter with a detected value of the temperature sensing section, the pre-set data being formed by the heater pre-heating temperature conditions, the variation of the temperature of the heater caused by the variation of the intra-room temperature and the variation of the heater temperature caused by the latent heat of the material; and a phase angle control section for controlling the phase angle of the AC power based on a phase angle control data furnished by the micro-computer.

BRIEF DESCRIPTION OF THE DRAWINGS

The above objects and other advantages of the present invention will become more apparent by the following detailed description describing in detail the preferred embodiment of the present invention with reference to the attached drawings in which.

DETAILED DESCRIPTION OF THE INVENTION

The capacity of a vaporizing type burner is decided by the size of the space to be warmed up, and the optimum pre-heating temperature of the heater is decided in accordance with the heating capacity of the burner. During the initial stage of warming up a room by means of a vaporizing type burner, the cool temperature of the room and the temperature of the vaporizing chamber almost correspond with each other. Even if an ac power is supplied to the heater of the burner, it is difficult to abruptly raise the cool temperature of the vaporizing chamber to such a level as to satisfy the vaporizing conditions.

That is, while the heater is heated by the AC power supplied, the temperature of the cool atmosphere within the vaporizing chamber can be slowly raised.

In contrast to an initial warming up of a room, a resumption of warming up a room will show some differences. However, the impossibility of instantly warming up the room exists almost in the same manner in both an initial warming up and a resumption of warming up.

Therefore, if the vaporizing atmosphere within the vaporizing chamber is to be maintained at the optimum level, it is necessary that the range of the variation of the heater temperature be set up by taking into account the intra-room temperature, and that the rate of the heat release of the heater be adjusted in accordance with the range of the variation of the heater temperature. This rate of heat release can be controlled by controlling the phase angle of the AC power as will be described below.

Further, when the heater is radiating heat, even if the AC power is disconnected, a latent heat exists owing to the physical characteristics of the heater.

That is, even if the AC power source is disconnected, the heater further releases heat to above a certain level. On the other hand, if the AC power is supplied again after disconnecting the power, the temperature of the heater drops to below a certain level after the power supply resumption. Thus, the heater radiates heat after the power disconnection, and drops to a lower temperature after the power re-supply. Therefore, the rate of the heat release of the heater has to be set to a different magnitude in accordance with the latent heat of the material of the heater. This is rendered possible by controlling the phase angle of the AC power.

Now the present invention will be described in further detail based on a preferred embodiment.

Figure 3:
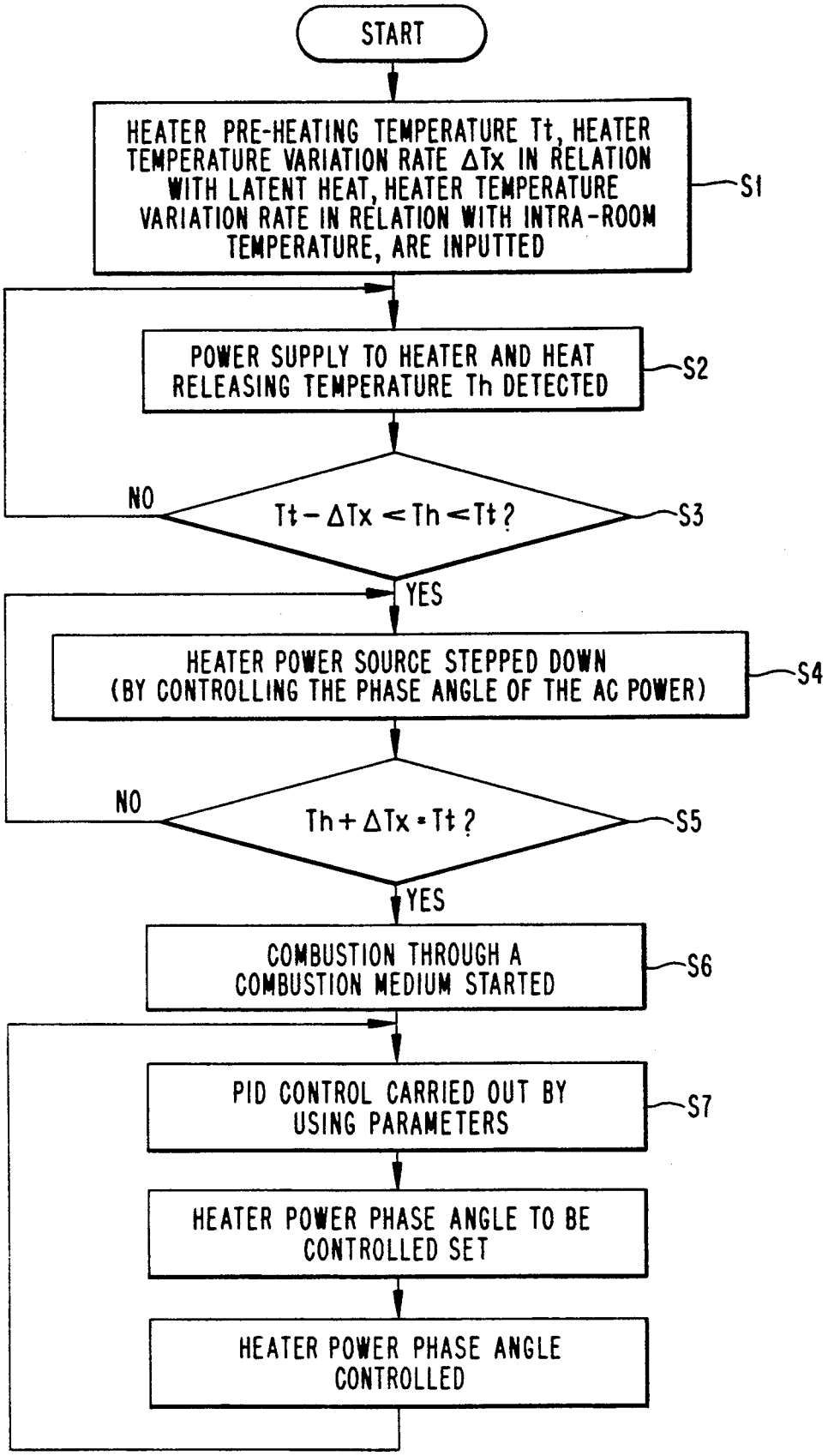
FIG. 3 illustrates a flowchart showing the constitution of the control method of the present invention.

That is, as shown in FIG. 3, the pre-heating temperature condition is set to maintain the temperature of the vaporizing chamber, so that it should be made possible to vaporize fuel as much as is required by the heating capacity of the burner. For doing this, the temperature variation range in relation with the latent heat and the temperature variation range in relation with the intra-room temperature variation are decided by experiments, thereby setting the temperature variation range of the heater. These factors, i.e., a heater pre-heating temperature Tt, a heater temperature variation rate $\Delta Tx$ and a heater temperature variation range in relation with the intra-room temperature are programmed into a microcomputer at a first step S1.

Then, at a second step S2, the AC power is supplied to the heater, and a heat releasing temperature Th of the heater is detected by means of a pre-heating thermistor and a heat sensing means installed adjacent to the heater. Then at a third step S3, the microcomputer compares the programmed conditions (Tt and $\Delta Tx$) with the heat releasing temperature Th of the heater as detected by the heat sensing means.

That is, a comparison is made as to whether the heater heat releasing temperature Th corresponds to the heater pre-heating temperature Tt (set in accordance with the heating capacity) within the latent heat temperature variation range $\Delta Tx$.

After the comparison, if it is found that the heat releasing temperature Th has not reached the above value ($Tt-\Delta Tx$), the rated voltage is supplied continuously without controlling the phase angle of the AC power. Then later, when the heat releasing temperature Th has reached the above value (Tt), the phase angle of the AC power is controlled to lower the supplied voltage at a fourth step S4.

Thereafter, at a fifth step S5, when the heater dissipates its latent heat as a result of the step-down of the supplied voltage, and if the microcomputer finds that the heat releasing temperature Th plus $\Delta Tx$ corresponds to the pre-heating temperature Tt, then the burner is subjected to combustion by using the combustion medium at a sixth step S6.

After making the burner carry out combustion, the parameters such as the heat releasing rate of the heater, the variation of the intra-room temperature, the latent heat temperature variation of the heater and the current temperature of the heater are used to maintain the vaporizing temperature at a constant level at a seventh step S7, and the parameters are subjected to the generally known proportionate integration-differentiation (PID).

The PID control of the AC power varies the phase angle of the AC power, and consequently, the power supply level of the AC power is adjusted.

For example, if the intra-room temperature is lower than at ordinary times, and so, if the heat releasing rate of the heater is increased, then the intra-room temperature condition comes into action as parameter, and the PID control is carried out in such a manner that the phase angle of the AC power should correspond with the phase angle of the supplied current flowing through the heater, thereby increasing the heat releasing rate of the heater.

On the other hand, if the intra-room temperature is higher than at ordinary times, and so, if the latent heat is released at a lowered rate, then control is carried out in such a manner that the phase angle of the AC power source should not correspond with the phase angle of the supplied current flowing through the heater, thereby lowering the heat releasing rate of the heater.

Thus, the microcomputer sets in advance the pre-heating temperature condition, the intra-room temperature condition and the latent heat condition, and the microcomputer compares the actual detected heater temperature and the intra-room temperature data based on a program. Then in accordance with the findings of the microcomputer, the heater is driven by controlling the phase angle of the AC power source, thereby assuring an atmosphere of a constant temperature level within the carburetor.

Figure 4:
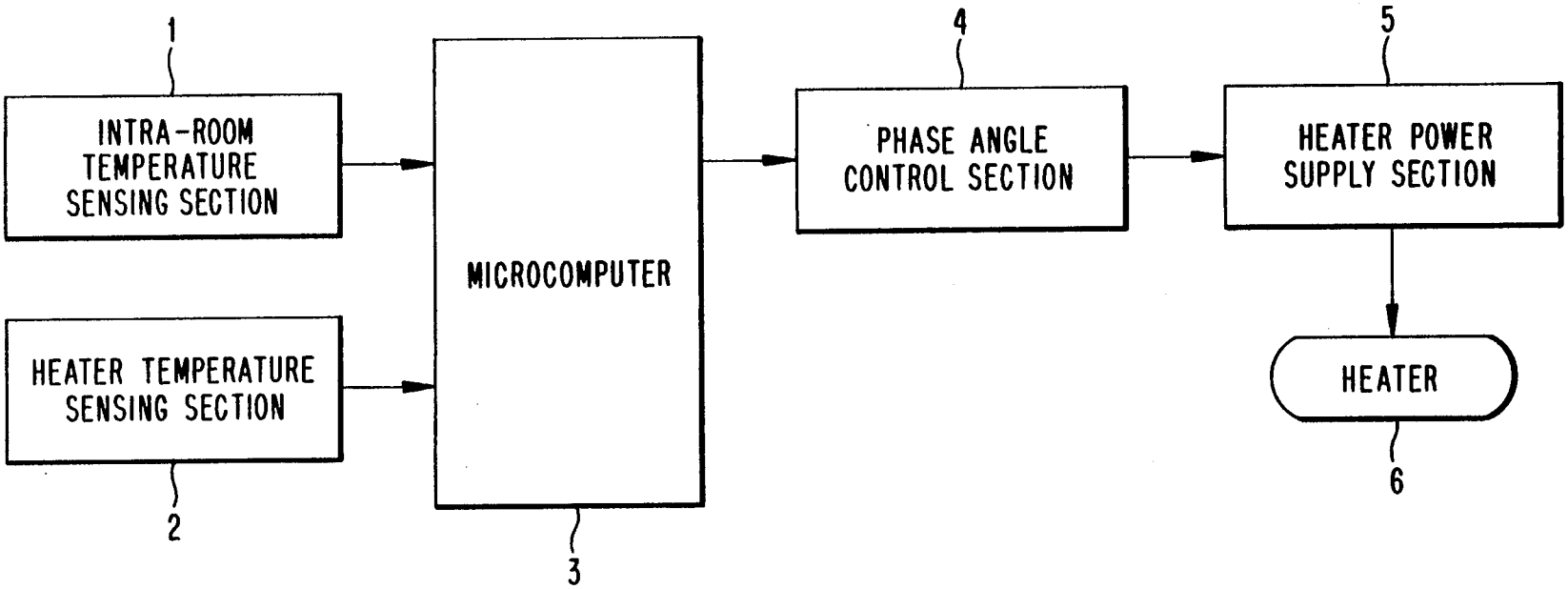
FIG. 4 is a block diagram showing the constitution of the heater control apparatus of the present invention.

As shown in FIG. 4, the preferred embodiment of the heater control apparatus includes: an intra-room temperature sensing section 1 for detecting the intra-room temperature condition by means of a temperature sensor such as a thermistor; and a heater temperature sensing section 2 having a temperature sensing means (same as the section 1) installed near the heater. The intra-room temperature sensing section 1 has to be placed at a position where the intra-room temperature at the carburetor can be accurately detected.

For example, the section i may be properly placed on the top of the burning apparatus where the radiant heat does not give much influence, being separated from the floor. However, the present invention is not limited to this, any positioning of the section 1 will be possible if the intra-room temperature is accurately detected.

The temperature sensor which constitutes the sensing section 2 is for detecting the heater temperature, and therefore, it may be properly placed by making it constitute a part of the vaporizing chamber together with the heater, but insulated from the heater. That is, it may be properly embedded in a vaporizing wall, or it may be properly placed anywhere if it is insulated from the heater and can accurately detect the temperature of the heater.

The intra-room temperature sensing section 1 and the heater temperature sensing section 2 described above are connected to the input side of the microcomputer 3, while the output side of the microcomputer 3 is connected to a phase angle control section 4 which is to be described below.

The phase angle control section 4 consists of an inverting type PID controller which is used generally for controlling the phase angle of AC power. That is, the microcomputer 3 compares the variations of the parameters mentioned above, and the result of the comparison is outputted to the phase angle control section 4, while the control section 4 carries out PID control on the AC power by using the parameters to cause the heater to release heat at the controlled rate.

The heater control unit described above will now be described with respect to its operation and effects.

Figure 1:
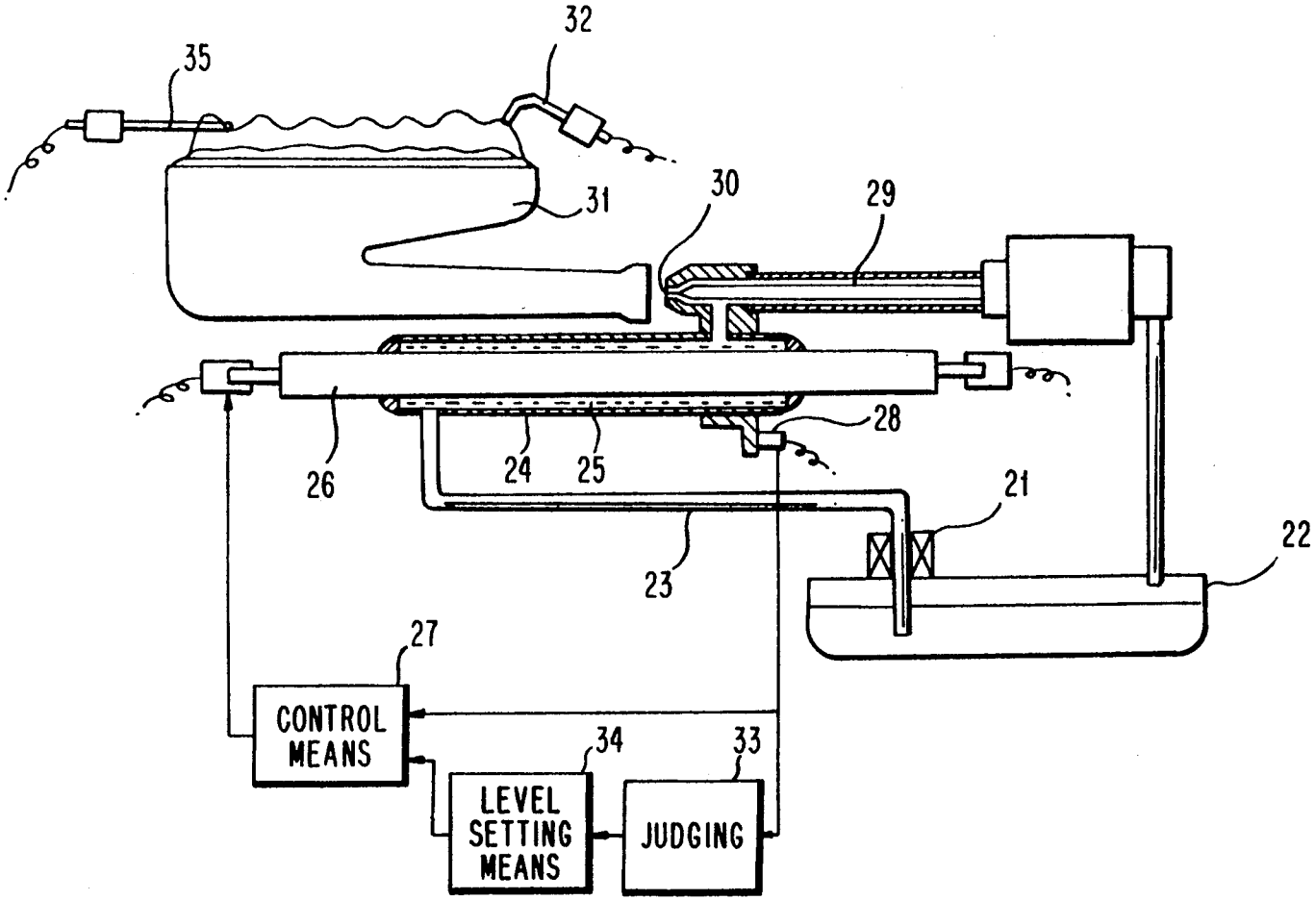
FIG. 1 (PRIOR ART)
FIG. 1 illustrates the over-all constitution of a conventional heater control apparatus for the carburetor.
Figure 2:
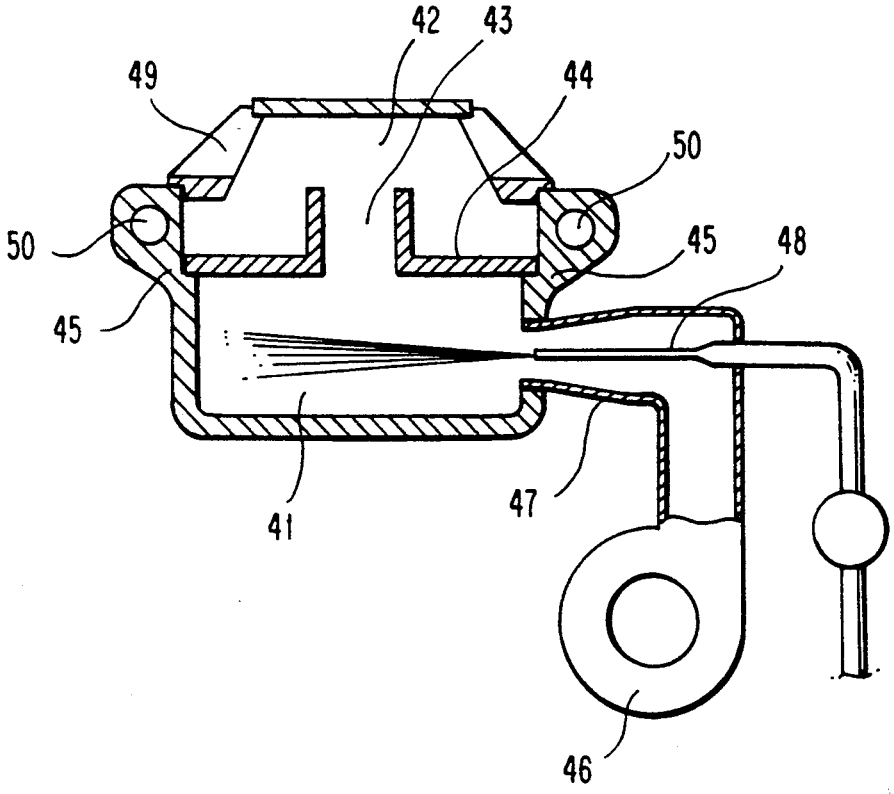
FIG. 2 (PRIOR ART)
FIG. 2 illustrates another form of a conventional heater control apparatus.

If a user turns on a start switch (not shown), power is supplied from a heater power supply section 5 to the heater 6, and the heater 6 is heated by the supplied power, resulting in a slow rise in the internal temperature of the vaporizing chamber 41 as shown in FIG. 2.

Under this condition, the temperature of the heater 6 is detected by the temperature sensor of the heater temperature sensing section 2, and the intra-room temperature is detected by the temperature sensor of the intra-room temperature sensing section 1. These detected temperatures are inputted into the microcomputer 3. The microcomputer 3 compares the inputted data with the pre-set data, and the result of the comparison is outputted to the phase angle control section 4 which is connected to the output side of the microcomputer 3.

The program, which is loaded into the microcomputer 3 for driving the phase angle control section 4 in accordance with the intra-room temperature, and the heater temperature will be described below.

That is, as described above, the parameters consist of: the heater pre-heating temperature condition for maintaining the atmosphere properly within the vaporizing chamber; the temperature variations by the latent heat inherent in the material of the heater; and the heater temperature variation caused by the variation of the intra-room temperature. These parameters are programmed into the microcomputer 3 which then compares the programmed parameters with the actually detected heat releasing temperature of the currently driven heater and with the intra-room temperature. Then the microcomputer 3 outputs the compared results, i.e., the control amount, to the phase angle control section 4.

Then, based on the instructions of the microcomputer 3, the phase angle control section 4 carries out proportionate integration-differentiation on the AC power supply. Consequently, the phase angle of the AC power is varied as a result of the PID control, and accordingly, the power is supplied to the heater in a variable form.

For example, if the microcomputer 3 demands to increase the heat release of the heater 6, the phase angle control section 4 steps up the power supplied to the heater 6. On the other hand, if it is requested to decrease the heat release of the heater 6, control section 4 steps down the power supplied to the heater 6.

Thus, by varying the heater pre-heating temperature in accordance with the current conditions, the atmosphere within the vaporizing chamber can be maintained in the optimum state, so that the fuel should be vaporized under the best condition, thereby contributing to warming the room to a comfortable state.

According to the heater control method and the heater control apparatus of the present invention as described above, the heater pre-heating temperature which is unavoidably varied by the surrounding conditions is judged by the microcomputer, and the value of the AC power supplied to the heater is controlled based on the judged results, so that a proper vaporizing atmosphere should be formed in relation with the surrounding conditions, thereby contributing to a full combustion of the fuel.

What is claimed is:

1. A method for controlling a heater of a carburetor in a vaporizing type fuel combustion apparatus, the method comprising the steps of:

setting, in a microcomputer, a heater pre-heating temperature condition for burning fuel at a predetermined state;

setting, in said microcomputer, a heater temperature variation rate in relation to latent heat of the material of said heater; and driving said heater with a variable AC power in accordance with the set heater preheating temperature condition and the heater temperature variation rate in said microcomputer.

2. A method for controlling a heater in accordance with claim 1 further comprising the step of:

carrying out, in said microcomputer, a proportionate integration differentiation on a phase angle of a supplied AC power in accordance with said set heater preheating temperature condition and said heater temperature variation rate, wherein said heater is driven with said variable AC power in accordance with said proportionate integration differentiation of said microcomputer.

3. A method for controlling a heater in accordance with claim 1, further comprising the step of:

setting, in said microcomputer, said heater temperature variation rate in relation to latent heat of the material of said heater and in relation with the intra-room temperature variation.

4. A method for controlling a heater in accordance with claim 3, further comprising the step of:

carrying out, in said microcomputer, a proportionate integration differentiation on a phase angle of a supplied AC power in accordance with said set heater preheating temperature condition and said heater temperature variation rate, wherein said heater is driven with said variable AC power in accordance with said proportionate integration differentiation of said microcomputer.

5. An apparatus for controlling a heater of a carburetor, the apparatus comprising:

a heater temperature sensing section for detecting the temperature of said heater by means of a temperature sensor and for producing a heater temperature signal indicative of the detected temperature;

a microcomputer, responsive to said heater temperature sensing section, for storing a heater pre-heating temperature condition and a heater temperature variation rate in relation with latent heat of the material of said heater, and for comparing said heater pre-heating temperature condition and said heater temperature variation rate with the detected heater temperature as indicated by said heater temperature signal and outputting control signals based on said comparison; and a heater power source supply section, responsive to said microcomputer, for supplying power to said heater in accordance with said control signals.

6. An apparatus for controlling a heater in accordance with claim 5, further comprising:

an intra-room temperature sensing section for detecting the intra-room temperature by means of a temperature sensor, and for producing an intra-room temperature signal indicative of said intra-room temperature, wherein said microcomputer stores said heater preheating temperature condition and a heater temperature variation rate in relation with variation of said intra-room temperature and in relation with the latent heat of the material of said heater, and wherein said microcomputer compares said heater pre-heating temperature condition and said heater temperature variation rate with sensed temperature data as indicated by said heater temperature signal and outputs said control signals based on said comparison.

7. An apparatus for controlling a heater in accordance with claim 6, wherein said heater power source supply section comprises:

a phase angle control section for controlling the phase angle of a supplied AC power in accordance with the control signals output from the microcomputer, wherein said heater power source supply section supplies a controlled AC power to said heater in accordance with said phase angle controlled by said phase angle control section.

8. An apparatus for controlling a heater in accordance with claim 7, wherein said heater power source supply section comprises:

a phase angle control section for controlling the phase angle of a supplied AC power in accordance with the control signals output from the microcomputer, wherein said heater power source supply section supplies a controlled AC power to said heater in accordance with said phase angle controlled by said phase angle control section.

* * * * *